United States Patent [19]

Rockwell

[11] Patent Number: 4,602,785

[45] Date of Patent: Jul. 29, 1986

[54] BARBELL EXERCISER WITH REST BRACKETS

[75] Inventor: Gary L. Rockwell, LaGrange, Ga.

[73] Assignee: Diversified Products Corporation, Opelika, Ala.

[21] Appl. No.: 568,128

[22] Filed: Jan. 4, 1984

[51] Int. Cl.[4] ..... A63B 13/00

[52] U.S. Cl. ..... 272/123; 272/93

[58] Field of Search ..... 272/134, 122, 93, 144, 272/124, 62, 70.1, 70.2, 116, 117, 103, 125, 123, 136; 248/293, 294; 182/186; 294/86.26, 86.27

[56] References Cited

U.S. PATENT DOCUMENTS

| | | | |
|---|---|---|---|
| 218,404 | 8/1879 | Shimoneck | 272/103 |
| 1,881,755 | 10/1922 | Logan et al. | 182/186 X |
| 2,071,257 | 2/1937 | Hansen | 248/293 X |
| 2,602,622 | 7/1952 | Smith | 248/294 X |
| 3,118,668 | 1/1964 | Callahan . | |
| 3,235,255 | 2/1966 | Leflar . | |
| 3,874,658 | 4/1975 | Flowers . | |
| 4,098,502 | 7/1978 | Faust . | |
| 4,201,380 | 5/1980 | Birch . | |
| 4,205,838 | 6/1980 | McIntosh . | |
| 4,231,570 | 11/1980 | Reis . | |
| 4,249,726 | 2/1981 | Faust . | |
| 4,252,314 | 2/1981 | Ceppo . | |
| 4,256,301 | 3/1981 | Goyette . | |
| 4,257,590 | 2/1981 | Sullivan et al. . | |
| 4,262,901 | 4/1981 | Faust . | |
| 4,286,782 | 9/1981 | Fuhrhop . | |
| 4,302,009 | 12/1981 | Johnson . | |
| 4,306,715 | 12/1981 | Sutherland . | |
| 4,319,747 | 3/1982 | Rogers . | |
| 4,353,585 | 10/1982 | Carver | 294/86.27 X |
| 4,411,425 | 10/1983 | Milnar . | |

FOREIGN PATENT DOCUMENTS

| | | | |
|---|---|---|---|
| 6226 | of 1893 | United Kingdom | 272/70.2 |

OTHER PUBLICATIONS

Model No. 9408—Universal Exercise Equipment Catalogue, 1980–1981, p. 20.

*Primary Examiner*—Richard J. Apley
*Assistant Examiner*—Robert W. Bahr
*Attorney, Agent, or Firm*—Banner, Birch, McKie & Beckett

[57] ABSTRACT

An exercise device for use with a downwardly biased free bar (such as a barbell) having a pair of retractable support assemblies pivotally mounted on a pair of uprights adjacent which the bar is moved during exercise. Each of the support assemblies includes a pivoted bracket which is biased to its retracted position generally flush with the upright, but which is readily pivoted to its extended position supporting the bar when contacted by the bar as the bar is moved downwardly.

12 Claims, 10 Drawing Figures

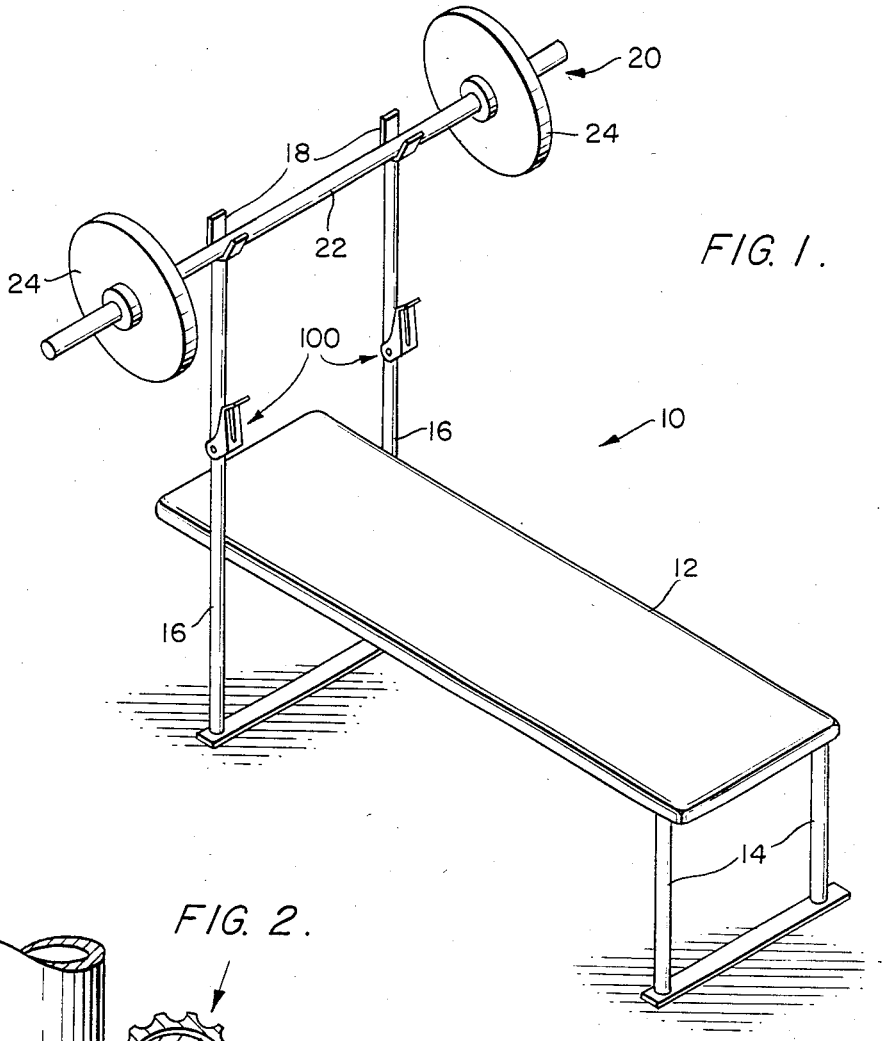
FIG. 1.
FIG. 2.
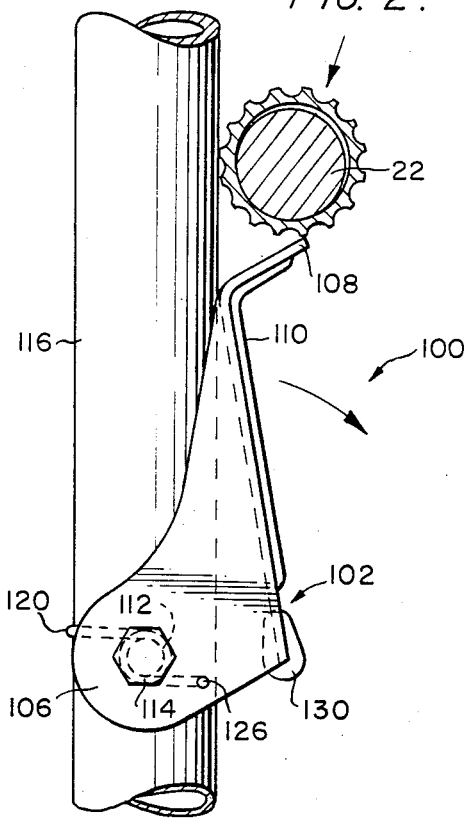
FIG. 3.
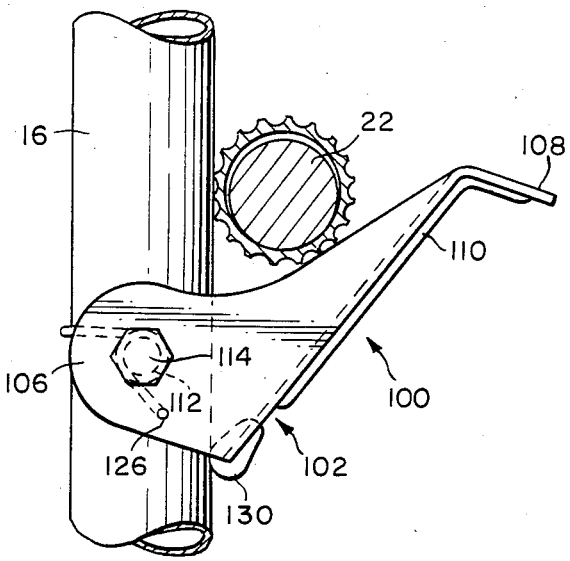

BARBELL EXERCISER WITH REST BRACKETS

BACKGROUND OF THE INVENTION

This invention relates to barbell-type exercising devices and, more particulary, to rest brackets for preventing injury to a fatigued user of a barbell-type exerciser.

The weighted barbell is perhaps the most basic and familiar of all weight-training exercise devices. Many different types of exercises can be performed using a barbell. These include bench presses (with the user lying on his back), standing presses (with the user standing upright) and squats (with the barbell held stationary at shoulder level). Often, these exercises are performed in conjunction with stationary exercise frames which include cradles or the like for holding the barbell at an initial position. For example, barbell uprights having cradles at their upper ends often are designed as integral parts of exercise benches, wherein the user will lie on his back between the uprights, remove the bar from the cradles, and commence raising and lowering the barbell. Other examples include taller upright frames having barbell cradles at a higher position from which the user removes the barbell for performing standing presses or squats.

In any of these exercise devices having uprights adjacent which the barbell is raised and lowered, there exists the possibility that a fatigued exerciser will lack sufficient strength to return the barbell to the cradles at the initial position adjacent the uppermost limit of travel. In order to prevent injury to the user, spotters often assist the user. However, in situations where additional personnel are not available to perform a spotting function, auxiliary barbell brackets or cradles may be positioned on the uprights at a small distance above the lowermost position of the barbell during exercise. Thus, if the fatigued user lacks the strength to raise the barbell to its initial height, he should at least be able to raise it slightly to the height of the auxiliary cradles and deposit it there to prevent injury to himself from the heavy barbell.

The problem with auxiliary barbell brackets or cradles is that they protrude far enough from the uprights to often interfere with exercising movement of the barbell. This can be an annoyance at the very least, and a potential danger in that it can upset the balance of the user and cause him considerable strain or, in the worst case, cause him to drop the barbell on himself. A significant need therefore exists in exercising equipment of this type for a barbell rest bracket or cradle arrangement which will not interfere with normal exercising movement of the barbell, but which reliably will catch and support a barbell when desired.

SUMMARY OF THE INVENTION

It is therefore an object of the present invention to provide an exercise device having simple and effective barbell rest brackets or cradles which do not interfere with normal exercising movement of the barbell.

It is another object of the invention to provide such an exercise device having barbell rest brackets which will remain substantially flush with the uprights of the exercise device during normal exercise movements, but which will be deployed to a barbell supporting position upon slight contact by the barbell itself.

These and other objects of the invention are accomplished by providing an exercising device adapted for use with a downwardly biased free bar. The device has a pair of spaced uprights adjacent which the bar is raised and lowered. Each upright includes a retractable bar support assembly which comprises a bar support bracket pivoted to the upright for movement between an upright, retracted position adjacent the upright and an extended bar supporting position transverse to the upright. The bracket has a projecting lip at the distal end thereof which protrudes from the upright when the bracket is in its retracted position. The assembly further comprises stop means for limiting downward pivotal movement of the bracket to its extended position, and biasing means coupled to the bracket for biasing the bracket to its retracted position. Accordingly, the bracket normally remains in its retracted position while the user exercises by raising and lowering the bar, but the bracket is deployed to its extended position to support the bar when the user desired to rest by contacting the lip with the bar during downward movement of the bar.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

FIG. 1 is a perspective view of an exercising bench which incorporates barbell support assemblies in accordance with the invention mounted on uprights of round cross-section;

FIG. 2 is a side elevational view of one of these assemblies in its retracted position;

FIG. 3 is a side elevational view of the same in its extended position;

DETAILED DESCRIPTION OF THE PREFERRED EMBODIMENTS

Figure 4:
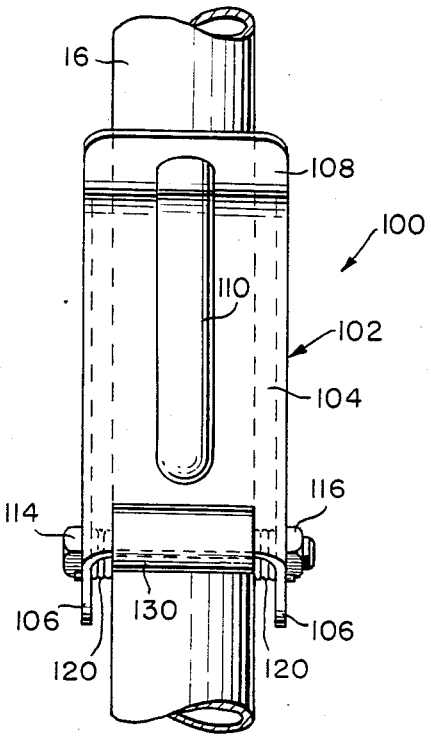
FIG. 4 is a front elevational view of the assembly of FIGS. 2 and 3.
Figure 5:
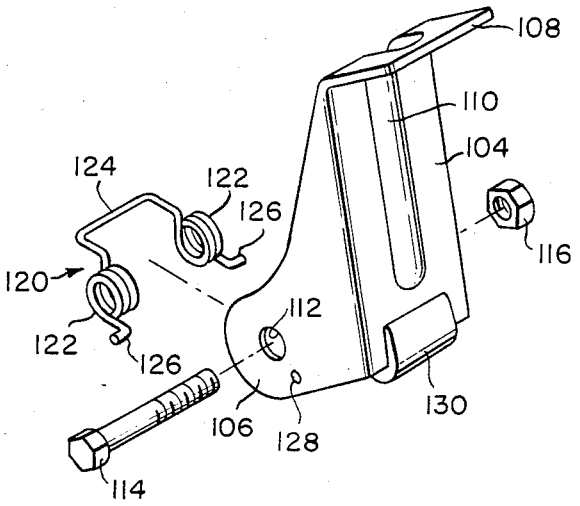
FIG. 5 is an exploded view of the support assembly of FIGS. 2, 3 and 4.

FIG. 1 illustrates the general organization of an exercising device having barbell support assemblies in accordance with the invention. This device is in the form of a bench 10 having a board 12 which is supported at one end by legs 14 and at the other end by uprights 16. Uprights 16 terminate at their upper ends in barbell cradles 18 which are adapted to stably support a barbell 20. Barbell 20 typically comprises a rigid bar 22 having removable weights 24 secured near the opposite ends thereof.

Barbell support assemblies 100 are secured to uprights 16 at a location which is slightly higher than the lowest anticipated position of the barbell during exercise. In this embodiment, for example, which comprises a bench used for performing chest presses, bar support assemblies 100 would be positioned slightly above the location of the barbell when it is close to or just touching the user's chest. The object is to provide support for the barbell at a height very close to this lowest position so that a fatigued exerciser can easily rest the barbell without having to raise it to any appreciable height.

It is to be understood that the bench device illustrated in FIG. 1 is merely exemplary of the type of exercise device on which the bar support assemblies may be mounted. Uprights 16 could be portions of the frame of a much larger exercise device having a bench 12 projecting thereform. Uprights 16 could be much taller than those illlustrated in FIG. 1 so that cradles 18 provide a higher starting position for barbell 20, such as for doing standing presses or squats. Regardless of the particular embodiment of the exercise device, the essence of the invention is the cooperation of the barbell with the bar support assemblies which are mounted on uprights adjacent which the bar is moved during exercise. The bar itself need not necessarily be part of a barbell assembly, but can be any type of downwardly biased free bar, that is, one which is (1) freely movable upwardly and downwardly, and toward and away from the uprights, so that the bar support assemblies can be engaged when desired, and (2) in some way under the influence of a downwardly directed force against which an exerciser must exert his muscular strength when the bar is raised. This would include the use of weights, springs attached to the bar by cables or the like, or any other suitable contrivance.

FIGS. 2, 3, 4 and 5 illustrate the details of bar support assembly 100. The assembly includes a bar support bracket 102 having an intermediate portion 140, generally parallel arms 106, and a projecting lip 108 at the distal end thereof. A common stiffening rib 110 extends across intermediate portion 104 and lip 108 to add rigidity to bracket 102. The entire bracket may be formed of sheet steel or any other sufficiently strong and rigid material, fabricated by means of any suitable manufacturing process.

Aligned holes 112 are formed in arms 106 at the proximal end of bracket 102. Aligned holes (not visible) also are formed in upright 16, so that bracket 102 is pivoted to upright 16 about a pivot bolt 114 which passes through all of the aligned holes and is secured at the opposite side by a nut 116. Bracket 102 is biased to its retracted position by means of a torsion spring 120 having two coaxial coils 122 which surround pivot bolt 114 and are disposed between upright 16 and arms 106. Coils 122 are coupled by an interconnecting portion 124, which engages the rear of upright 16. The ends 126 of torsion spring 120 are anchored in spring holes 128 in arms 106. A resilient bumper 130 is provided at the proximal end of intermediate portion 104 to protect the finish of upright 16 when bracket 102 is forced to its extended position by barbell 22 (see FIG. 3).

Referring to FIGS. 2 and 3, the operation of the barbell support assembly now will be described. When in its retracted position (FIG. 2), bracket 102 lies fairly close to upright 16 and does not hinder vertical movement of bar 22 during normal exercise, since the bar usually is positioned several inches in front of the upright. The orientation of projecting lip 108 is such that downward movement of the bar very close to upright 16 will cause bracket 102 to pivot about bolt 114 to the position illustrated in FIG. 3, with bumper 130 in engagement with upright 16. The inclined upper surfaces of arms 106 direct bar 22 against upright 16 to firmly support the barbell in brackets 102. The mere lifting of bar 22 automatically permits brackets 102 to retract to the position illustrated in FIG. 2.

Figure 6:
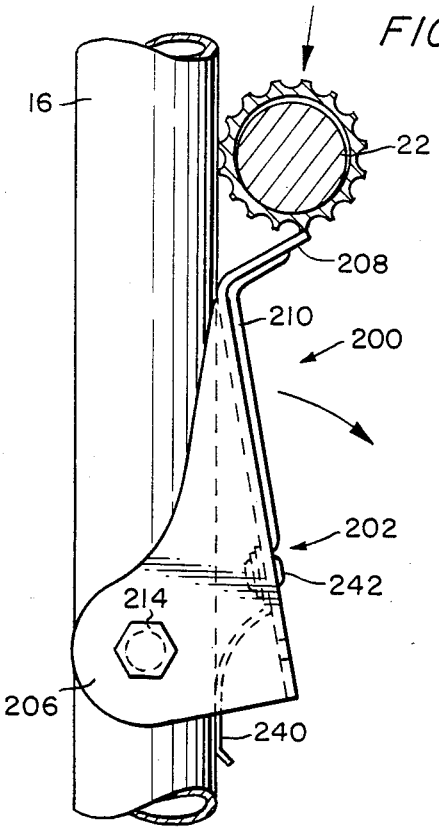
FIG. 6 is a side elevational view of a second embodiment of a support assembly in its retracted position.
Figure 7:
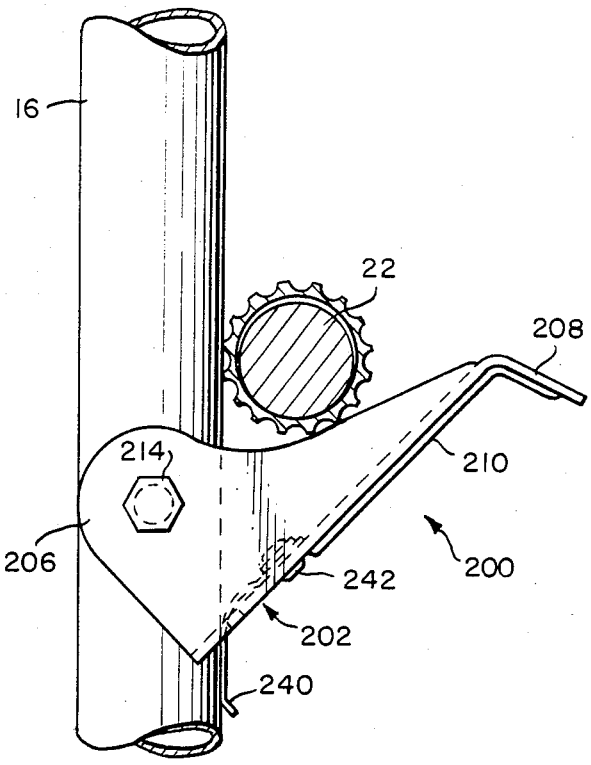
FIG. 7 is a side elevational view of the assembly of FIG. 6 shown in its extended position.
Figure 8:
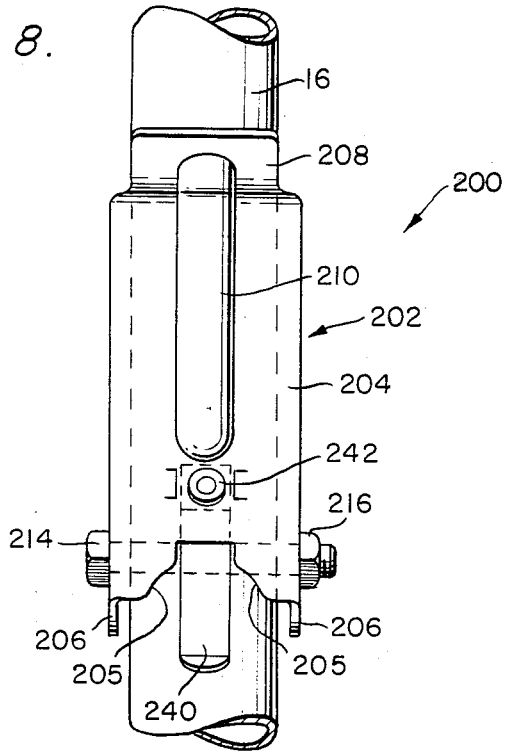
FIG. 8 is a front elevational view of the assembly of FIGS. 6 and 7.

An alternative form of the invention is illustrated in FIGS. 6, 7 and 8. In this embodiment, elements similar to those of the previous embodiment are designated by like 200 series reference numerals. The primary difference resides in the means for biasing the bracket to the retracted position. In this embodiment, the biasing means comprises a cantilevered leaf spring 240 which is secured to the intermediate portion 204 of bracket 202 by a rivet 242 or other suitable fastener. The other end of leaf spring 240 bears against the front side of upright 16, below pivot bolt 214, to exert a force which restores bracket 202 to its retracted position. The proximal end of intermediate portion 204 is notched at 205 so as to approximate the curved contour of round upright 16 and more effectively distribute the load when bracket 202 is in its extended position.

Figure 9:
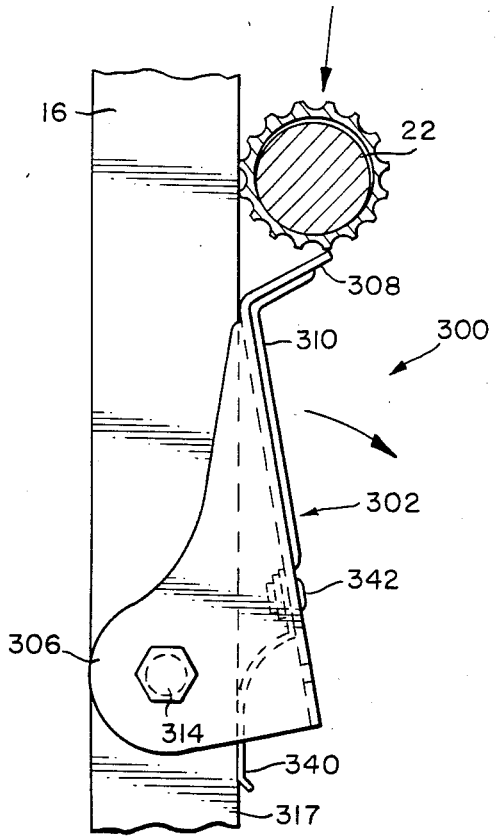
FIG. 9 is a side elevational view similar to FIG. 6, showing the assembly mounted on an upright of square cross-section.
Figure 10:
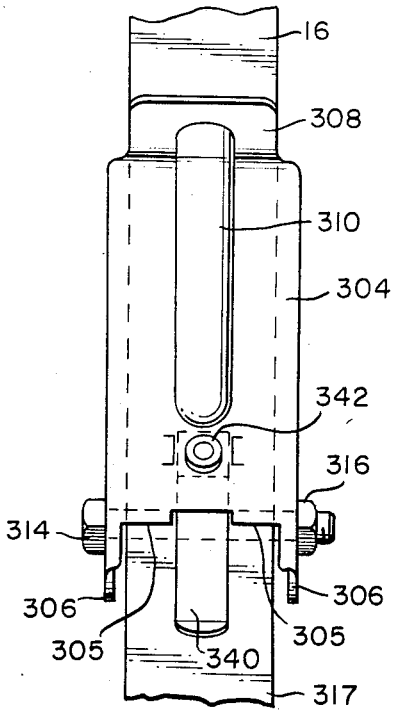
FIG. 10 is a front elevational view of the assembly of FIG. 9.

A third embodiment is illustrated in FIGS. 9 and 10, where similar elements are designated by like 300 series reference numerals. This embodiment is similar to that of FIGS. 6, 7 and 8 (utilizing a leaf spring), but is specifically designed for installation on an upright 316 of square cross section, having a flat front surface 317 against which the proximal end of intermediate portion 304 bears when bracket 302 is in its extended position. Accordingly, this proximal end has a straight edge 305 which properly mates with the flat surface 317 of upright 316.

It will be obvious to one of ordinary skill that numerous modifications may be made without departing from the true spirit and scope of the invention, which is to be limited only by the appended claims.

I claim:

1. An exercising device adapted for use with a downwardly biased free bar, said exercise device having a pair of spaced uprights adjacent which said bar is raised and lowered by a user, an upper bar support means on each of said uprights, and a retractable bar support assembly on each of said uprights below and spaced from said bar support means, said retractable bar support assembly comprising:

a bar support bracket pivoted to said upright for movement between an upright, retracted position adjacent said upright and an extended bar-supporting position transverse to said upright, said bracket having a projecting lip at the distal end thereof which protrudes from said upright when said bracket is in its retracted position;

stop means for limiting downward pivotal movement of said bracket to its extended position; and biasing means coupled to said bracket for biasing said bracket to its retracted position, said bracket normally remaining in its retracted position while the user exercises by raising and lowering said bar, and said bracket being deployed to its extended position to support said bar when the user desires to rest by contacting said lip with said bar during downward movement of said bar.

2. An exercising device according to claim 1 wherein said bar support bracket comprises a pair of spaced arms flanking and pivoted to said upright, said lip projecting from and interconnecting the distal ends of said arms.

3. An exercise device according to claim 2 wherein said bar support bracket further comprises an intermediate portion interconnecting said arms and said lip, and said stop means comprises the proximal end of said intermediate portion positioned to abut said upright when said bracket is in its extended position.

4. An exercising device according to claim 3 wherein said arms, said lip and said intermediate portion are integrally formed as a one-piece bracket, and said arms are substantially parallel.

5. An exercising device according to claim 4 wherein said stop means further comprises a resilient bumper on the proximal end of said intermediate portion which contacts said upright to protect the finish thereof.

6. An exercising device according to claim 4 wherein said bracket is formed of rigid sheet material, said intermediate portion and said lip have a common stiffening rib extending thereacross, and said arms and said upright have aligned holes through which a pivot bolt passes to pivotally attach said bracket to said upright.

7. An exercising device according to claim 6 wherein said stop means further comprises a resilient bumper on the proximal end of said intermediate portion which contacts said upright to protect the finish thereof.

8. An exercising device according to claim 6 wherein said biasing means comprises a torsion spring mounted on said pivot bolt, said torsion spring having two spaced coaxial coils surrounding said pivot bolt between said arms and flanking said upright, an interconnecting portion between said coils which abuts said upright, and two ends anchored on said arms.

9. An exercising device according to claim 6 wherein said biasing means comprises a cantilevered leaf spring anchored at one end to said intermediate portion, the distal end of said leaf spring engaging said upright below said pivot bolt.

10. An exercising device according to claim 2 wherein said biasing means comprises a torsion spring engaging said upright and at least one of said arms, said torsion spring acting about the pivots for said arms.

11. An exercising device according to claim 2 wherein said biasing means comprises a cantilevered leaf spring anchored at one end to said bracket, the distal end of said leaf spring engaging said upright.

12. An exercise device according to claim 1 wherein said bar support assemblies are located on said uprights slightly higher than the lowest position of said bar during exercise, so that the user can rest the bar on said bar support assemblies when fatigued.

* * * * *